US010247402B2

(12) United States Patent
Chen

(10) Patent No.: US 10,247,402 B2
(45) **Date of Patent: *Apr. 2, 2019**

(54) LAMP DEVICE

(71) Applicant: Ching-Hui Chen, Huizhou (CN)

(72) Inventor: Ching-Hui Chen, Huizhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/810,364

(22) Filed: Nov. 13, 2017

(65) Prior Publication Data

US 2018/0135845 A1 May 17, 2018

(30) Foreign Application Priority Data

Nov. 14, 2016 (CN) ..... 2016 2 1224577 U

(51) Int. Cl.

| | |
|---|---|
| ***F21S 6/00*** | (2006.01) |
| ***F21V 23/06*** | (2006.01) |
| ***F21V 1/04*** | (2006.01) |
| ***H01R 13/74*** | (2006.01) |
| *H01R 13/512* | (2006.01) |
| *H01R 24/60* | (2011.01) |
| *H01R 24/76* | (2011.01) |

(52) U.S. Cl.

CPC ..... *F21V 23/06* (2013.01); *F21S 6/00* (2013.01); *F21V 1/04* (2013.01); *H01R 13/74* (2013.01); *H01R 13/512* (2013.01); *H01R 13/743* (2013.01); *H01R 24/60* (2013.01); *H01R 24/76* (2013.01)

(58) Field of Classification Search

CPC ..... F21V 1/04; F21V 23/06; H01R 13/512; H01R 13/74; H01R 24/60; H01R 24/76

USPC ..... 362/253

See application file for complete search history.

(56) References Cited

U.S. PATENT DOCUMENTS

| | | | | |
|---|---|---|---|---|
| 8,545,039 | B2 * | 10/2013 | Patel | F21S 6/002 307/43 |
| 9,109,791 | B2 * | 8/2015 | Lin | F21V 33/0052 |
| 9,472,955 | B2 * | 10/2016 | Jones | H02J 4/00 |
| 2016/0153650 | A1 * | 6/2016 | Chien | F21V 33/0004 362/253 |
| 2017/0159929 | A1 * | 6/2017 | Li | F21V 33/0024 |
| 2018/0138645 | A1 * | 5/2018 | Chen | H01R 13/743 |

* cited by examiner

*Primary Examiner* — Seung H Lee

(74) *Attorney, Agent, or Firm* — Rosenberg, Klein & Lee

(57) ABSTRACT

The present invention discloses a lamp device, which comprises a base, a lamp seat installed in the base and electrically connected with a circuit board, at least one USB interface, and a lamp shade hooding the lamp seat thereinside. The USB interface includes a cartridge disposed in the base and a USB socket module disposed inside the cartridge. The USB socket module is separated from the circuit board and electrically connected with the circuit board through cables. A wall of the cartridge has at least one opening. The interface of an external USB data line can be passed through the opening and inserted into the socket of the USB socket module. The USB interface is reduced to a smaller size and requires less space for installation. Therefore, the position for installing the USB interface has higher selectivity, and the overall esthetics of the base is improved.

8 Claims, 4 Drawing Sheets

LAMP DEVICE

This application claims priority for China patent application no. 201621224577.1 filed on Nov. 14, 2016, the content of which is incorporated by reference in its entirety.

BACKGROUND OF THE INVENTION

Field of the Invention

The present invention relates to an illumination technology, particularly to a lamp device.

Description of the Related Art

Nowadays, many lamp devices are equipped with USB connectors where USB power cords can be connected to recharge electronic products, such as mobile phones, tablet computers, electronic books, etc.

The existing lamp device equipped with USB connectors mainly comprises a base, a lamp seat installed in the base, a lamp, a circuit board and USB connectors. The interfaces of the USB connectors are soldered onto the circuit board and electrically connected with the circuit board, cooperating with the circuit board to form an integral structure. However, such a structure containing the USB connectors and the circuit board occupies a larger volume and may hinder the installation of the USB connectors. For example, it is inconvenient to install the USB connectors in the base of the lamp device, especially a smaller base. Further, the bulky USB connectors are likely to degrade the overall esthetics of the base.

SUMMARY OF THE INVENTION

The primary objective of the present invention is to provide a lamp device to improve the convenience of installing the USB interfaces and the overall esthetics of the base of the lamp device.

In order to achieve the abovementioned objective, the present invention proposes a lamp device, which comprises a base, a lamp seat installed in the base, a circuit board, at least one USB interface, and a lamp shade hooding the lamp seat thereinside. The lamp seat is electrically connected with the circuit board. The USB interface includes a cartridge disposed in the base and a USB socket module disposed inside the cartridge. The USB socket module is separated from the circuit board and electrically connected with the circuit board through cables. The USB socket module includes at least one of Type-C USB sockets, Micro USB sockets, and Mini USB sockets. A wall of the cartridge, which is corresponding to the socket of the USB socket module, has at least one opening. The interface of an external USB data line can be passed through the opening and inserted into the socket of the USB socket module.

The present invention respectively disposes the USB socket module and the circuit board at different positions, whereby to reduce the size of the USB interface and decrease the space volume required for installing the USB interface. Therefore, the present invention can increase the flexibility of installing the USB interface (e.g. installing the USB interface in a smaller base) and improve the overall esthetics of the base.

DETAILED DESCRIPTION OF THE INVENTION

Below, embodiments and attached drawings are described in detail to clearly and completely demonstrate the technical contents of the present invention. It should be noted: these embodiments are not all the embodiments but only a part of the embodiments of the present invention; the embodiments made by the persons having ordinary knowledge in the field according to the technical contents of the present invention without creative labor would be included by the scope of the present invention.

It should be noted also: the positional or directional adjective used in the specification, such as upper, lower, left, right, front, rear, top, bottom, inner, outer, vertical, horizontal, transverse, longitudinal, clockwise, counterclockwise, circumferential, radial, axial, etc., is only to describe the relative position of the components in a special viewing angle. If the viewing angle is changed, the positional or directional description should be changed also.

It should be noted further: the ordinal adjective, such as first, second, etc., used in the specification is not necessarily to imply the importance of the described item or the quantity of the total items in the same group but normally to distinguish one from the others among the same group. While "first" or "second" is used to describe an item, it indicates or implies that at least one mentioned item exits in the embodiment. Two embodiments can be integrated if the persons having ordinary knowledge in the field can realize the integration of the technical schemes thereof. If the technical schemes of two embodiments are contradictory and the integration thereof is unlikely to realize, the integration of the two embodiments is regarded as impossible and not included by the scope of the present invention.

The present invention proposes a lamp device.

Figure 3:
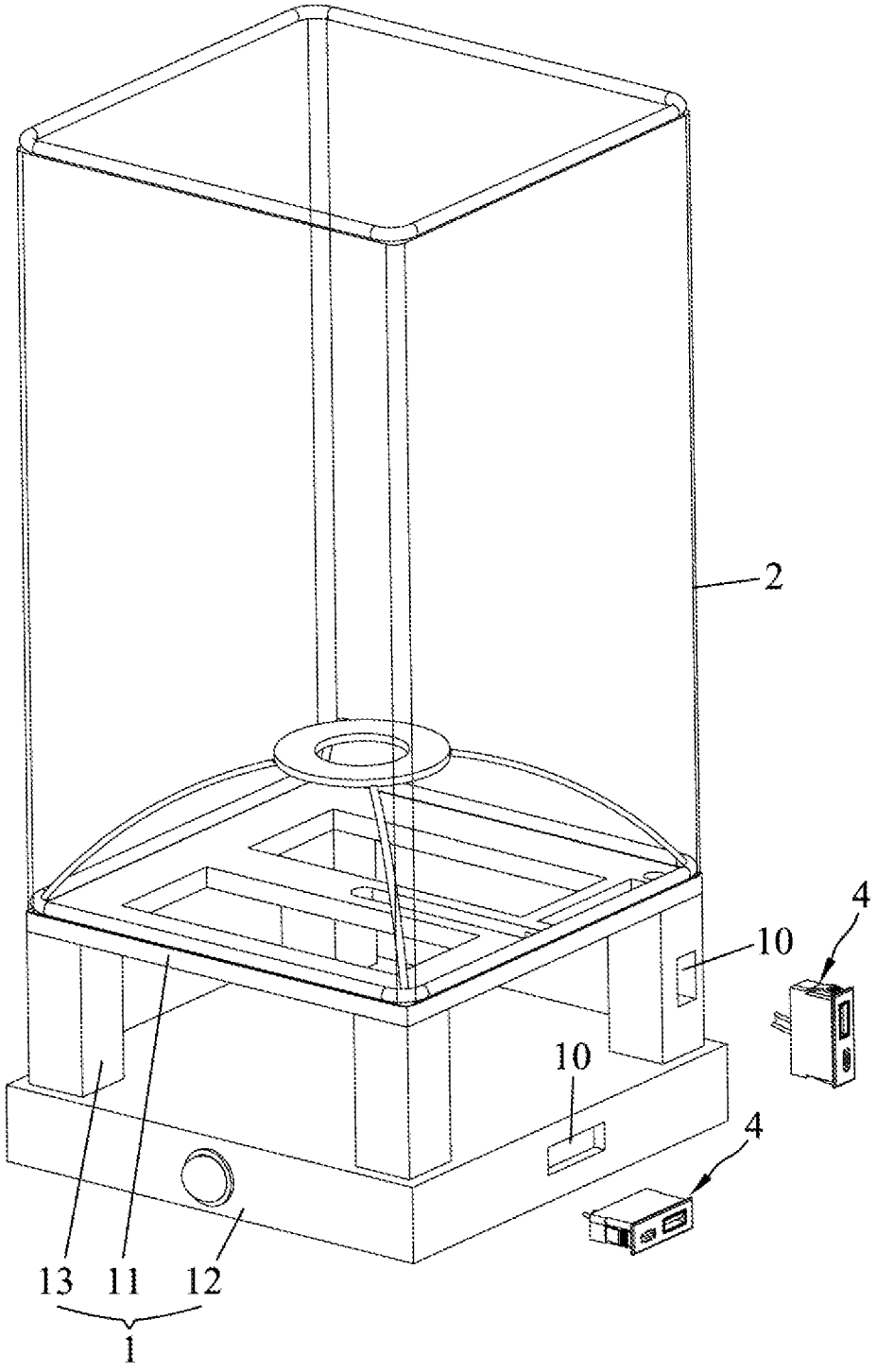
FIG. 3 is an exploded view schematically showing a portion of a lamp device according to one embodiment of the present invention.
Figure 4:
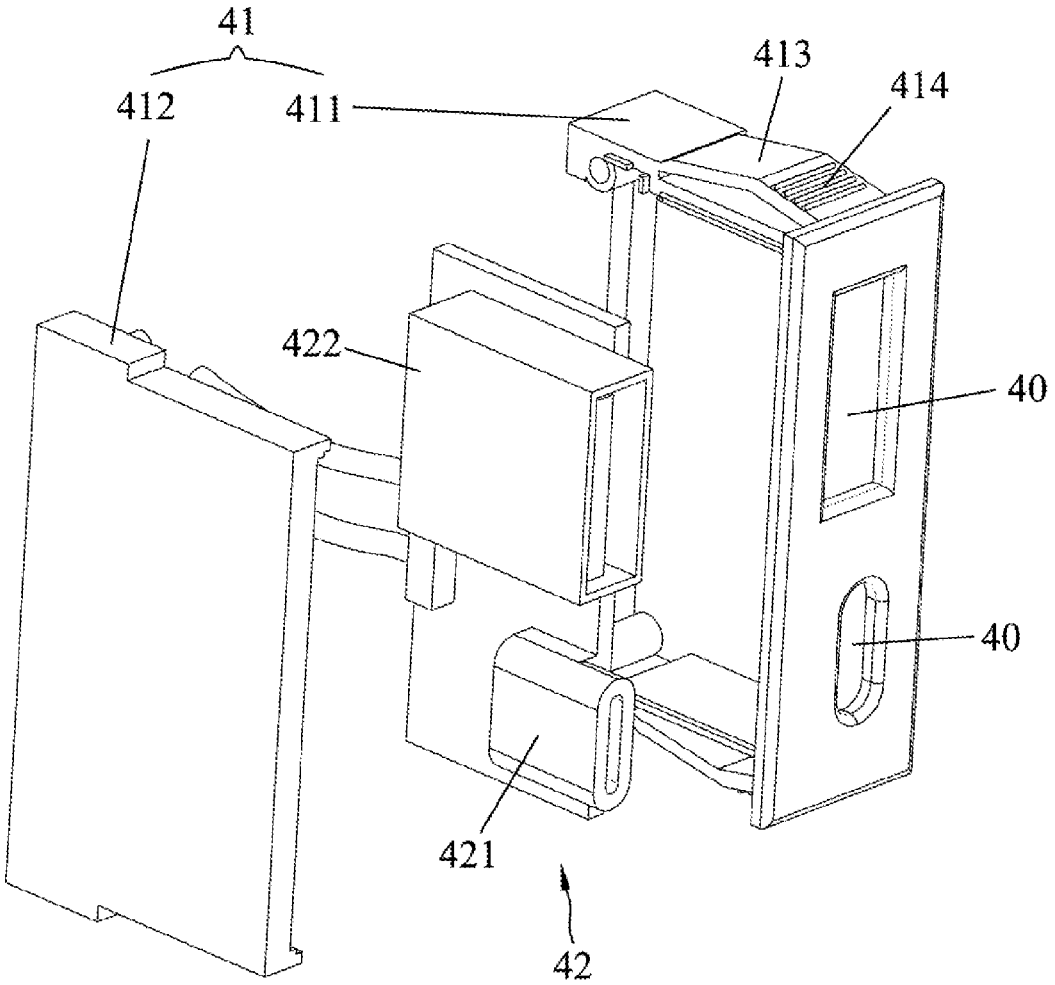
FIG. 4 is an exploded view schematically showing a USB interface of a lamp device according to one embodiment of the present invention.

Refer to FIGS. 1-4. In one embodiment, the lamp device of the present invention comprises a base 1, a lamp seat (not shown in the drawings) installed in the base 1, a circuit board 3, at least one USB interface 4, and a lamp shade 2 installed on the base 1. The lamp shade 2 hoods the lamp seat thereinside. The lamp seat is electrically connected with the circuit board 3, and a lamp is installed in the lamp seat. The circuit board 3 is electrically connected with a power source (not shown in the drawings) through a power cord. The power source may be commercial power or batteries. The USB interface 4 includes a cartridge 41 installed in the base 1 and a USB socket module 42 installed inside the cartridge 41. The USB socket module 42 is separated from the circuit board 3 and electrically connected with the circuit board 3 through cables 43. The USB socket module 42 includes at least one of Type-C USB sockets 421, Micro USB sockets 422, and Mini USB sockets (not shown in the drawings). As shown in FIG. 4, the USB socket module 42 includes a Type-C USB socket 421 and a Micro USB socket 422. Thereby, the USB interface 4 is reduced to a smaller size and requires less space for installation. Therefore, the position of installing the USB interface 4 has higher selectivity. For example, the USB interface 4 can be installed in a smaller base 1. Further, the overall esthetics of the base 1 is improved. A wall of the cartridge 41, which is corresponding to the socket of the USB socket module 42, has at least one opening 40. The interface of an external USB data line, such as a Type-C USB data line, a Micro USB data line, or a Mini USB data line, can be passed through the opening 40 and inserted into the socket of the USB socket module 42.

Figure 1:
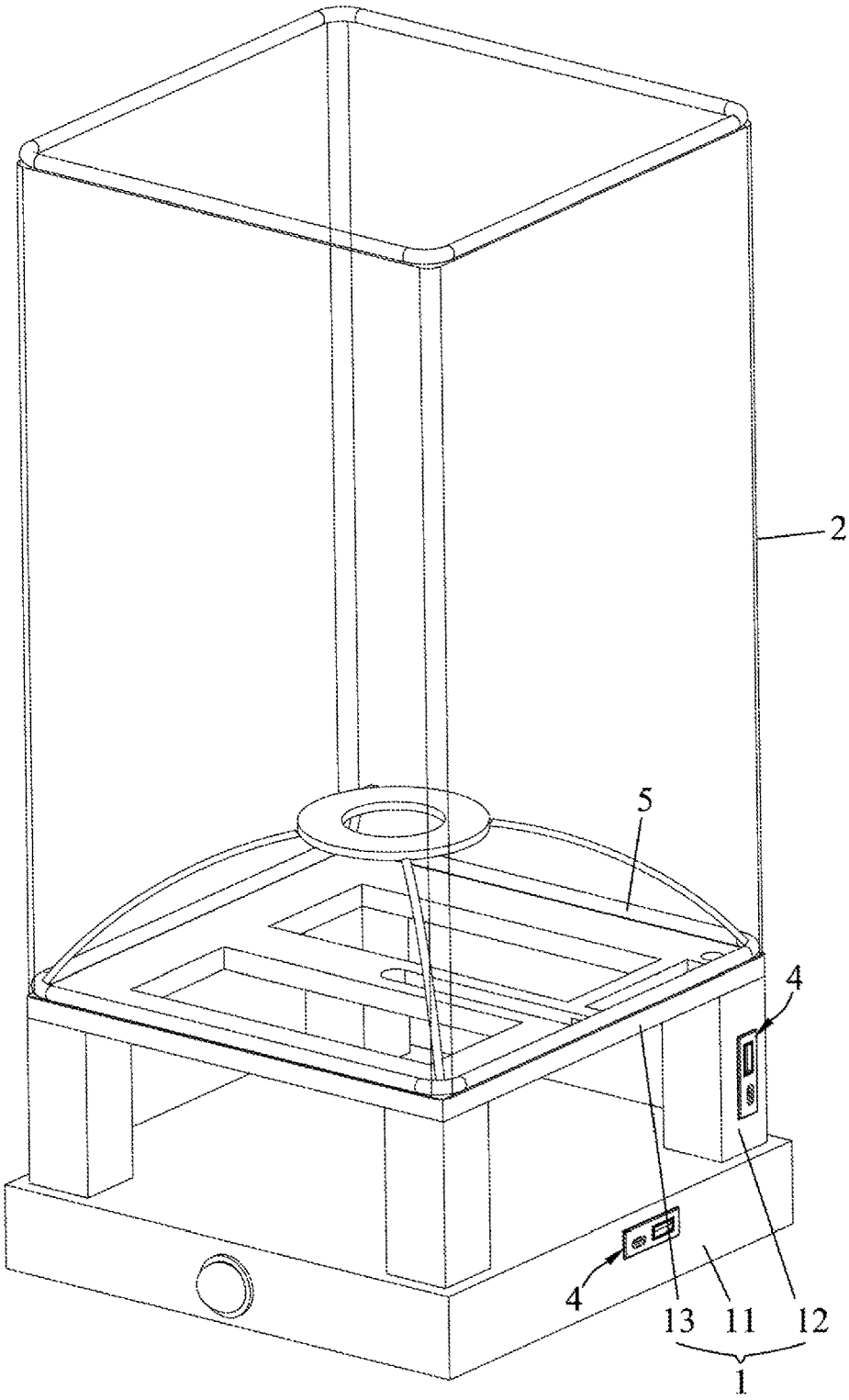
FIG. 1 and FIG. 2 are perspective views taken from two different viewing angles for schematically showing a lamp device according to one embodiment of the present invention.
Figure 2:
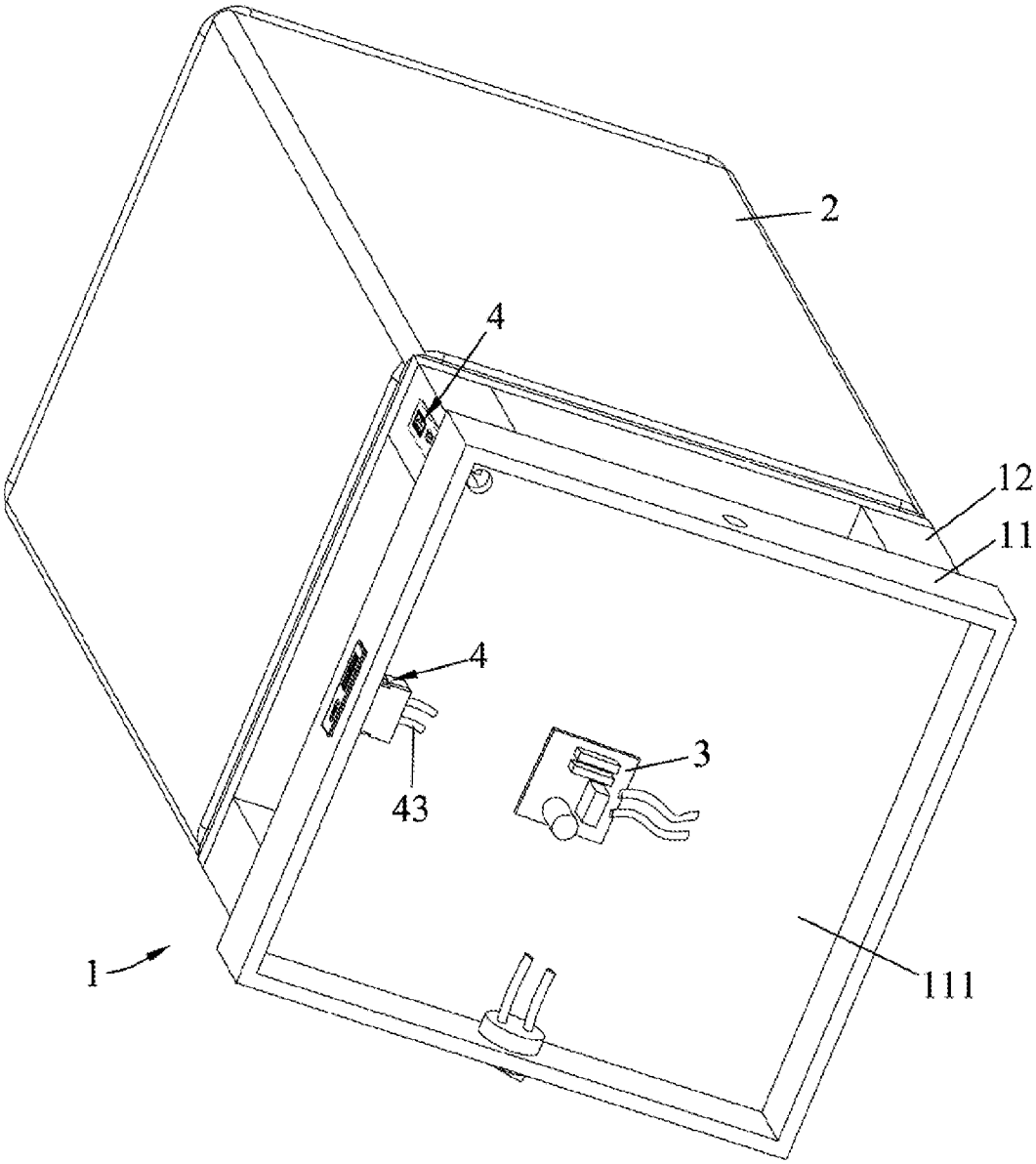

As shown in FIG. 1, in this embodiment, the base 1 includes a baseplate 11, a plurality of studs 12 installed on the baseplate 11, and a support platform 13 connected with the tops of the studs 12. The lamp seat is installed on the support platform 13. In one embodiment, four studs 12 are adopted and distributed in a rectangular way. In other embodiments, three, five, or more studs are used.

In the present invention, one or more USB interfaces 4 are used. In the embodiment shown in FIG. 1, there are two USB interfaces 4. The baseplate 11 and/or at least one stud 12 has an installation hole 10 for installing the cartridge 41. In installing the cartridge 41, the opening 40 is faced outward, whereby the interface of the external USB data line can be inserted into the socket of the USB socket module 42.

Refer to FIG. 4. In one embodiment, the cartridge 41 is made of plastic and includes a casing 411 whose one side is open and a cover 412 connected with the casing 411 and covering the casing 411. The casing 411 and the cover 412 are detachably connected with each other. For example, the casing 411 and the cover 412 are detachably connected with and each other via screws or press-fit mechanisms. Besides, the casing 411 and the cover 412 can be detachably connected with each other via pins and pin holes.

Refer to FIG. 3 and FIG. 4. In one embodiment, the cartridge 41 has avoidance recesses on at least one set of opposite sides. An elastic plate 413 is arched upward and connected with the front wall and the rear wall of the avoidance recess. While pressed, the elastic plate 413 is elastically deformed toward the avoidance recess. One surface of the elastic plate 413, which faces outward, has press-fit teeth 414 protruding outward. After the cartridge 41 is press-fitted into the installation hole 10, the press-fit teeth 414 press against the corresponding wall of the installation hole 10, whereby the cartridge 41 is tightly secured inside the installation hole 10.

In one embodiment, the bottom of the baseplate 11 has a recess 111. The circuit board 3 is disposed inside the recess 111. The side wall of the recess 111 has the installation hole 10 for installing the USB interface 4.

In one embodiment, the lamp shade 2 is made of a transparent or semi-transparent material, such as a transparent or semi-transparent plastic, or a transparent or semi-transparent glass. In one embodiment, the lamp shade 2 is a sleeve-like structure, and the top and bottom of the lamp shade 2 are opened. In one embodiment, the surface of the support platform 13 has a limit frame 5. The lamp shade 2 is placed inside the limit frame 5 and constrained by the limit frame 5. The bottom wall of the lamp shade 2 is supported by the support platform 13.

The embodiments described above are only to exemplify the present invention but not to limit the scope of the present invention. The equivalent modification or variation according to the technical contents disclosed in the specification is to be also included by the scope of the present invention.

What is claimed is:

1. A lamp device comprising a base, a circuit board, a lamp seat installed in said base and electrically connected with said circuit board, at least one USB interface, and a lamp shade hooding said lamp seat thereinside, wherein said USB interface includes a cartridge disposed in said base and a USB socket module disposed inside said cartridge, and wherein said USB socket module is separated from said circuit board and electrically connected with said circuit board through cables, and wherein said USB socket module includes at least one of Type-C USB sockets, Micro USB sockets, and Mini USB sockets, and wherein a wall of said cartridge, which is corresponding to a socket of said USB socket module, has at least one opening, and wherein an interface of an external USB data line is passed through said opening and inserted into said socket of said USB socket module, said base includes a baseplate, a plurality of studs installed on said baseplate, and a support platform connected with tops of said studs, and wherein said lamp seat is installed on said support platform, and there are one or more said USB interfaces, and wherein said baseplate and/or at least one said stud has an installing hole for installing said cartridge, and wherein after said cartridge is installed in said installation hole, said opening is faced outward.

2. The lamp device according to claim 1, wherein there are four said studs disposed in a rectangular way.

3. The lamp device according to claim 1, wherein said cartridge is made of plastic and includes a casing whose one side is open and a cover connected with said casing and covering said casing.

4. The lamp device according to claim 3, wherein said casing and said cover can be detachably connected with each other.

5. The lamp device according to claim 1, wherein said cartridge has avoidance recesses on at least one set of opposite sides; an elastic plate is arched upward and connected with a front wall and a rear wall of said avoidance recess; while pressed, said elastic plate is elastically deformed toward said avoidance recess; one surface of said elastic plate, which faces outward, has press-fit teeth protruding outward; after said cartridge is press-fitted into said installation hole, said press-fit teeth press against a wall of said installation hole, which faces said press-fit teeth.

6. The lamp device according to claim 1, wherein a bottom of said baseplate has a recess; said circuit board is disposed inside said recess; a side wall of said recess has said installation hole.

7. The lamp device according to claim 1, wherein said lamp shade is made of a transparent plastic, a semi-transparent plastic, a transparent glass, or a semi-transparent glass.

8. The lamp device according to claim 1, wherein said lamp shade is a sleeve-like structure; a top and a bottom of said lamp shade are opened; a surface of said support platform has a limit frame; said lamp shade is placed inside said limit frame and constrained by said limit frame; a bottom wall of said lamp shade is supported by said support platform.

* * * * *